United States Patent [19]

Staffin et al.

[11] Patent Number: 4,512,821

[45] Date of Patent: Apr. 23, 1985

[54] METHOD FOR METAL TREATMENT USING A FLUIDIZED BED

[75] Inventors: Robert Staffin, Colonia; Carol A. Girrell, North Brunswick; Mario A. Fronzoni, East Brunswick, all of N.J.

[73] Assignee: Procedyne Corp., New Brunswick, N.J.

[21] Appl. No.: 450,921

[22] Filed: Dec. 20, 1982

[51] Int. Cl.[3] ..... C21D 1/53

[52] U.S. Cl. ..... 148/16.5; 148/16.6; 148/20.3; 432/197

[58] Field of Search ..... 432/15, 58, 197, 27; 148/16, 16.5, 16.6, 16.7, 20.3, 126

[56] References Cited

U.S. PATENT DOCUMENTS 3,666,253 5/1972 Yoshio et al. ..... 266/257
4,220,445 9/1980 James et al. ..... 432/250
4,239,480 12/1980 Hyre ..... 431/264
4,279,406 7/1982 Bourhis et al. ..... 266/81
4,340,433 7/1982 Harding ..... 148/16

FOREIGN PATENT DOCUMENTS 1438550 6/1976 United Kingdom ..... 432/15

*Primary Examiner*—L. Dewayne Rutledge
*Assistant Examiner*—Christopher W. Brody
*Attorney, Agent, or Firm*—Kane, Dalsimer, Kane, Sullivan and Kurucz

[57] ABSTRACT

The present invention involves an apparatus and method for heat treating metal workpieces in chemically controlled environments produced by decomposition of an atmosphere precursor, e.g. methanol or ethyl acetate, introduced to a heated fluidized bed retort as a vapor.

15 Claims, 1 Drawing Figure

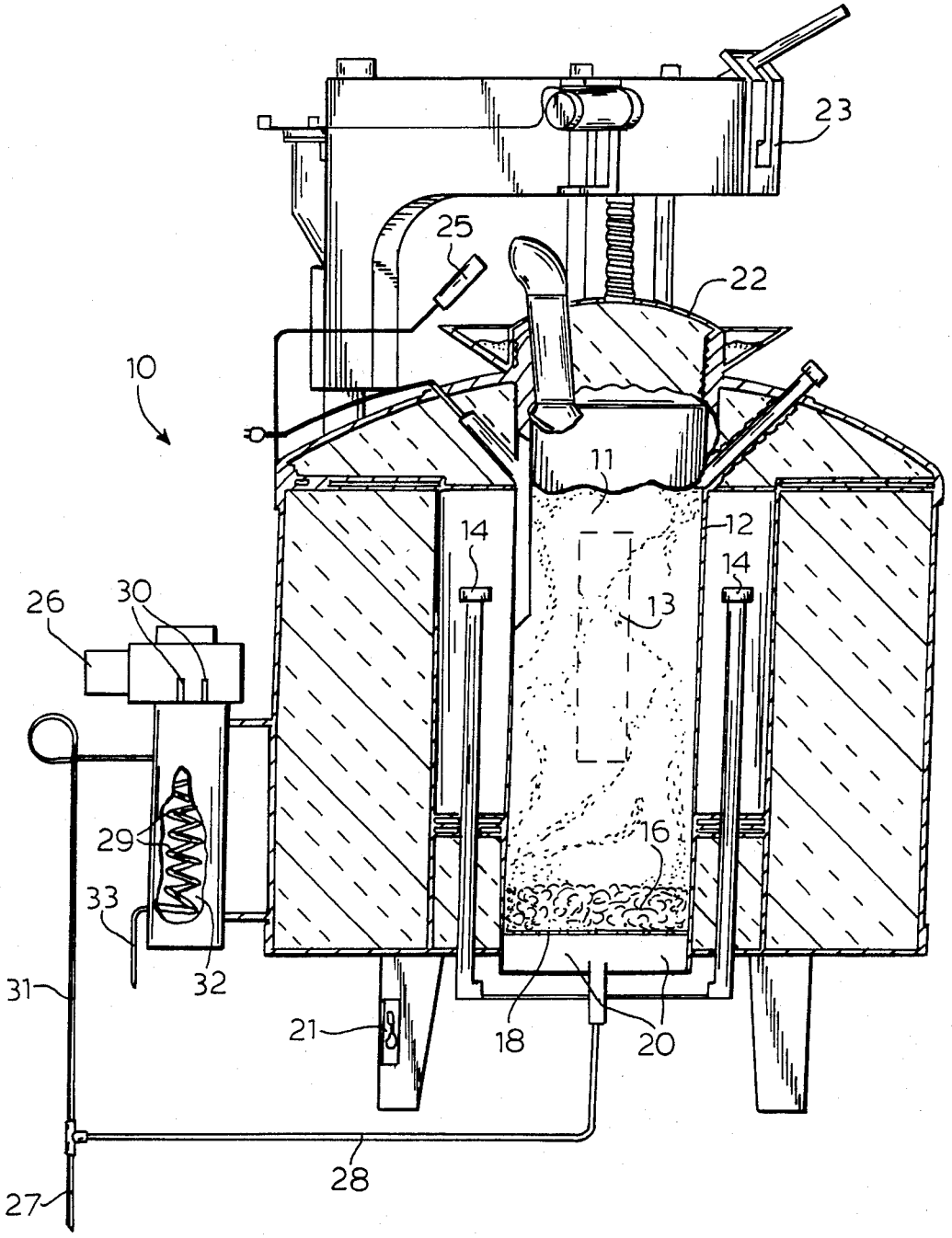
23
25
22
10
11
12
14
14
13
26
30
29
16
33
32
31
21
18
20
28
27

METHOD FOR METAL TREATMENT USING A FLUIDIZED BED

FIELD OF THE INVENTION

The present invention relates to the field of thermal treatment of metals and in particular carburizing, carbonitriding, through hardening, carbon restoration, carburizing and like processes which require furnace atmospheres having a specific composition.

DESCRIPTION OF THE PRIOR ART

Processes for improving the physical characteristics of metal workpieces, e.g. parts, castings, forgings, and the like, including carburizing, carbonitriding, case hardening through hardening, carbon restoration, normalizing, stress relieving, annealing, and the like, that require controlled furnace atmospheres are well known and are hereinafter referred to collectively as Metal Treatment Processes.

Generally, these processes involve exposing a metal workpiece to elevated temperatures in a furnace having controlled atmospheres that either alter or maintain the chemical composition of the workpiece. For example, when a workpiece composed of a carbon containing ferrous metal, like steel, is exposed to hot furnace atmospheres, carbon may either diffuse into or out of the steel workpiece depending primarily on temperature and composition of the furnace atmosphere. If the furnace atmosphere contains significant amounts of water vapor hydrogen ($H_2$), carbon dioxide ($CO_2$) or other substances that react with carbon at elevated temperatures; carbon will be removed from the steel workpiece changing its composition and physical properties. If the furnace atmosphere is carbonaceous, i.e. having a nascent carbon concentration, i.e. carbon potential, greater than the workpiece and is essentially free of substances that react with nascent carbon; carbon may be added to the steel workpiece to modify its physical properties, e.g. hardness and wear resistance.

Similarly, if ammonia is added to a carbonaceous furnace atmosphere, nitrogen as well as carbon may be added to the steel workpiece providing additional hardness and wear resistance. Therefore, the composition of a workpiece or workpiece surface may be altered or maintained at metal treatment process temperatures by controlling the composition of the furnace atmosphere.

The various aspects of producing controlled furnace atmospheres for specified metal treatment processes are well known. See: American Society of Metals, Metals Handbook, Metals Park, Ohio (1964), Vol. 2, pp. 67–128.

Controlled furnace atmospheres for metal treatment processes are typically derived from partially combusted hydrocarbons, e.g. methane, partially combusted with air in a suitable furnace. The resulting atmosphere may consist of approximately, 40% $N_2$, 40% $H_2$, 20% CO and small amounts of $H_2O$, $CO_2$ side products and impurities. In processes intended to add carbon to the workpiece surface, $H_2O$ and $CO_2$ are undesirable because they cause side reactions that reduce the atmosphere carbon potential. Typically, this problem is controlled by providing additional hydrocarbon to the atmosphere that reacts with the $H_2O$ and $CO_2$ preventing reduction of the carbon potential.

Recently it has been shown that metal treatment atmospheres having the same or more advantageous compositions than those derived from hydrocarbons burned in air as described above, are obtained by thermal decomposition of certain oxygenated hydrocarbons, e.g. U.S. Pat. Nos. 4,306,918 and 4,145,232. There are several distinct advantages to using oxygenated hydrocarbon derived furnace atmospheres for metal treatment processes including faster and more uniform carbon transfer to the metal.

Fluidized bed furnaces are well known in the metal treatment arts for their advantages of rapid and uniform heat transfer, ease of use, and safety. See U.S. Pat. No. 3,053,704. Conventional fluidized bed furnaces may comprise a retort or treating vessel containing a finely divided particulate solid heat transfer medium, e.g. aluminum oxide. A distributor plate is positioned at the lower end of the retort for introducing fluidizing gas to the retort upwardly through the bed media from a plenum chamber below. The fluidizing gas suspends the bed media in an expanded mass that behaves like a liquid. Heat is transmitted to the expanded mass from electric heaters, or the like, either directly or through the walls of the retort and/or the fluidizing gas may be heated before it enters the retort. A workpiece submerged in the heated expanded mass is rapidly and uniformly heated.

Heat treatment atmospheres derived from liquid oxygenated hydrocarbons such as methanol, referred to above, have not been found compatible with fluidized bed metal treatment processes because the liquids are difficult to handle and introduce into a heated retort in controlled quantities. For example, hot gaseous methanol is extremely flammable and rapidly condenses into the liquid state when its temperature is lowered. The flamability causes safety problems and the rapid condensation causes severe difficulty in pipeline construction and accurate measurement of the gas by conventional techniques, such as flowmeters, where there is a potential for cold spots that can cause condensation. Furthermore, vaporization itself is an endothermic process that can cause localized condensation in vaporizer devices that interferes with accurate measurement of the gas. This problem is compounded by the fact that the oxygenated hydrocarbons cannot usually be preheated to temperatures approaching that of the retort temperatures required for many metal treatment processes because it may prematurely decompose into inactive or undesirable side products like $CO_2$, $H_2O$ and soot (free carbon). Other problems with using vaporized liquid oxygenated hydrocarbons in fluidized bed metal treatment furnaces are associated with the fact that the flow rate of the gas must be within relatively narrow parameters to achieve proper fluidization of the bed media.

SUMMARY OF THE INVENTION

The present invention provides a method and apparatus for creating controlled metal treatment atmospheres in fluidized beds from low molecular weight liquid oxygenated hydrocarbon compounds having no more than 8 carbon atoms, and normally no more than 4 including alcohols anhydrides, ethers, esters and mixtures thereof; preferably ethanol, acetaldehyde, dimethylether, methylformate, and methylacetate; and more preferably methanol and ethylacetate. These metal treatment atmosphere producing compounds, hereinafter referred to as atmosphere precursors or AP's are often mixed with other substances usually inert gases such as nitrogen or argon and with carbon bearing gases like methane or propane for carbon potential control before entering the fluidized bed to produce the desired atmosphere. Vaporization takes place in an apparatus, preferably placed in the AP feed line or the lower plenum of a conventional fluidized bed. In any case, the vaporization must be conducted in a zone sufficiently insulated from high retort temperatures to prevent premature decomposition of the AP. Above the fluidized bed distributor plate a layer of very coarse, perhaps 10 mesh, material sometimes called 'grog' insulates the plenum chamber from the high retort temperatures and conducts the AP into the retort before it decomposes. The thickness of the grog layer will depend on the particular process contemplated, the AP used and required flow rates. In certain applications, grog that has been used successfully included $Al_2O_3$ (aluminum oxide) and $SiO_2$ (Silica Sand). However, it will be appreciated that many materials that are not reactive at the contemplated temperatures and in the contemplated atmosphere will serve as grog materials.

A particular advantage of the present invention is that there is no leakage and the positive exclusion of air from the retort. In non-fluidized bed furnaces, air contamination frequently results from leakage causing undesirable lowering of carbon potential by both dilution of the furnace atmosphere and reaction of $O_2$, $CO_2$, and $H_2O$ with carbon monoxide. Air contamination of conventional furnace metal treatment atmospheres is common and usually requires significant additions of from 2–20% of a hydrocarbon to prevent excessive reduction of the carbon potential. These additions make the composition of the atmosphere unstable requiring constant monitoring by chemical analysis. In the present invention such additions are typically less than 1% if required at all and the atmospheres are correspondingly stable and the need for monitoring the composition of the atmosphere is greatly reduced, and in some cases, eliminated altogether.

Another advantage of the present invention is the thermal uniformity of the fluid bed resulting from the high thermal conductivity and high heat transfer coefficient of the liquid like expanded mass. In contrast, conventional furnaces are usually heated by fuel fired or electric elements operated at temperatures well in excess of the furnace temperature which cause 'hot spots' that often result in non-uniform heating of a workpiece therein. Nonuniform heating causes the carbon content to vary in substantially the same workpiece.

With the above and other incidental objects and advantages in view as will more fully appear herein, the invention intended to be protected by letters patent consists of the features of construction, the parts and combinations thereof, and the mode of operation as hereinafter described, or illustrated in the accompanying drawings, or their equivalents.

BRIEF DESCRIPTION OF THE DRAWINGS

FIG. 1, is a perspective view of a metal treatment furnace and vaporizer constructed in accordance with the present invention and a cutaway portion to show the furnace interior.

In this drawing certain fittings, valves, instruments, heaters, agitators, pumps, thermal controls and the like, have been omitted for purposes of clarity and they may be provided in any suitable conventional manner where necessary or desirable.

DETAILED DESCRIPTION OF THE INVENTION

As shown in FIG. 1, a preferred embodiment of the metal treatment system of the present invention comprises a fluidized bed furnace 10 having a retort 12 equipped with heaters 14. A layer of insulating 'grog' 16 is disposed along the bottom of retort 12 and just above distributor plate 18 thermally insulating plenum 20 from the retort 12. Expanded mass of particulate bed material 11 is disposed in retort 12 just above grog 16. The retort 12 may be sealed from the outside atmosphere with an insulated cover 22 that is easily opened and closed by mechanism 23 to permit access to the retort 12 for insertion and removal of workpieces e.g. workpiece 13, and other service operations. A vent is provided in the cover with pilot burner system 25 to burn off the fluidizing gases as they leave the retort. Alternatively, an exhaust gas conduit from the cover 22 to a conventional cyclone (not shown) can be added which separates solids, i.e. entrained bed media from spent fluidizing gas and discharges into the atmosphere or a chemical reclamation or recycling device (not shown).

The plenum 20 may optionally be provided with cooling means 21 which is a conventional cooling coil or refrigeration device or the like.

Heated vaporizer 26 is in fluid communication with plenum 20 via conduits 31 and 28. Vaporizer 26 may comprise a plurality of electric heaters 30 imbedded in an insulator, e.g. insulated aluminium block 32. Vaporizer coil 29 is disposed in block 32 and fed with liquid AP's by conduit 33 which is provided with flow meter and valve (not shown) for measuring and controlling the flow of liquid AP's to heat exchanger coil 29. It will be appreciated that the heat exchanger coil 29 may be of any convenient shape and preferably maximizes heat transfer from heater elements 30 to AP passing therethrough and provides sufficient space for vaporization of the AP at the desired flow rate.

In operation a measured amount of AP liquid, e.g. methanol, flows through conduit 33 regulated by valve (not shown) and enters heat exchanger coil 29 in vaporizer 26 wherein its phase changes from liquid to gaseous without undergoing chemical change. The vapor is then conducted via conduit 31 to conduit 28 wherein it mixes with auxiliary gases from gas control panel (not shown) through conduit 27 and subsequently enters the plenum via conduit 28.

The AP or an AP/auxiliary gas mixture passes upwardly through passages in distributor plate 18, then through grog 16 and into retort 12. The high temperatures in the retort 12 cause the AP to rapidly decompose into the desired metal treatment atmosphere that acts upon workpiece 13. For example, methanol undergoes the following reaction at temperatures greater than about 600° F.:

| | |
|---|---|
| $CH_3OH$ | $2H_2 + CO$ |

and if the methanol is mixed with nitrogen in the amount of 40% of the total fluidizing gas atmosphere, the resulting furnace atmosphere would have a composition similar to commercially generated endothermic gas with a nominal composition of:

| | |
|---|---|
| $N_2$ | 40% |

-continued

| | |
|---|---|
| $H_2$ | 40% |
| CO | 18–20% |

It will be apparent to those skilled in the art that reduced air contamination is a significant advantage and that a variety of improved atmospheres for various metal treatment processes are made possible by the present invention. It will be further appreciated that it is in the nature of a fluid bed to exclude gases not entering from below the surface of the expanded mass, i.e. air, so that cover 22 while preferable is not necessary to the present invention.

Because nitrogen may be added as a fluidization component and does not originate from the combustion of air as in a conventional atmosphere generator, it can be eliminated completely in favor of additional AP or any other metallurgically acceptable gas, e.g. argon.

Furthermore, active non-hydrocarbon type auxilliary gases can be added to modify the atmosphere composition; for example, the addition of ammonia ($NH_3$) to the fluidizing gas results in a conbonitriding atmosphere. A typical composition would be 35% nitrogen, 55% methanol vapor and 10% ammonia.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but the best contemplated modes of putting the invention into effect and the invention is therefore claimed in any of its forms or modifications within the legitimate and valid scope of the appended claims.

What is claimed is:

1. A method of producing chemically controlled atmospheres for treating metal workpieces in fluidized beds, which comprises:

providing a precursor liquid that upon decomposition establishes a desired atmosphere in a fluidized bed;

vaporizing the precursor liquid externally of the fluidized bed;

introducing the vaporized precursor liquid into a plenum associated with the fluidized bed;

maintaining the vaporized precursor liquid within the plenum at temperatures between its vaporization and decomposition temperatures;

introducing the vaporized precursor liquid to the fluidized bed wherein it thermally decomposes into selected chemical entities that provide at least a portion of the desired atmosphere.

2. A method of producing chemically controlled atmospheres recited in claim 1, in which:

the step of independently vaporizing the precursor liquid before maintaining it at a temperature between its vaporization and decomposition temperatures.

3. A method of producing chemically controlled atmospheres recited in claim 1, in which:

the precursor liquid is methanol.

4. A method of producing chemically controlled atmospheres recited in claim 1, in which:

the precursor liquid is ethyl acetate.

5. A method of producing chemically controlled atmospheres recited in claims 2 or 3, further comprising:

the step of adjusting the chemically controlled atmosphere with auxiliary gases.

6. A method of producing chemically controlled atmospheres recited in claim 5, in which:

an auxiliary gas is an inert gas which dilutes the atmosphere.

7. A method of producing chemically controlled atmospheres recited in claim 6, in which:

the inert gas is nitrogen and it comprises approximately 40% of the atmosphere.

8. A method of producing chemically controlled atmospheres recited in claim 6, in which:

the inert gas is argon and it comprises approximately 40% of the atmosphere.

9. A method of producing chemically controlled atmospheres recited in claim 1, further comprising the step of:

passing the vaporized atmosphere precursor through an insulation layer prior to introduction to the fluidized bed wherein the insulation layer provides insulation from high retort temperatures.

10. A method of producing chemically controlled atmospheres recited in claim 1, in which:

air is excluded from the fluidized bed and leakage of air into the fluidized bed is prevented.

11. A method of producing chemically controlled atmospheres recited in claim 5, in which:

the auxiliary gas is ammonia which, when added to the fluidized gas, results in a carbonitriding atmosphere.

12. A method of producing chemically controlled atmospheres for treating metal workpieces in fluidized beds, which comprises:

providing methanol which is normally in liquid form;

vaporizing the methanol externally of the fluidized bed;

maintaining the methanol between its vaporization and decomposition temperatures;

providing a fluidized bed and means for heating the fluidized bed;

introducing the vaporized methanol to the fluidized bed at a temperature between its vaporization and decomposition temperatures;

causing the vaporized methanol to thermally decompose in the fluidized bed into selected chemical fractions that provide at least a portion of the selected atmosphere.

13. A method of producing chemically controlled atmospheres recited in claim 12, further comprising:

providing a preheating means which is spaced from and is in fluid communication with the fluidized bed;

performing the step of vaporizing methanol by introducing liquid methanol to the preheating means then heating the liquid methanol to a temperature between its vaporization and decomposition temperatures.

14. A method of producing chemically controlled atmospheres recited in claim 12 further comprising:

the step of excluding air from the fluidized bed and preventing leakage of air into the fluidized bed.

15. A method of producing chemically controlled atmospheres recited in claim 12 further comprising:

the step of adjusting the chemically controlled atmosphere with auxiliary gases.

* * * * *